US006685134B2

(12) United States Patent
Trosky et al.

(10) Patent No.: US 6,685,134 B2
(45) Date of Patent: Feb. 3, 2004

(54) ARTILLERY ROCKET

(75) Inventors: Bernhard Trosky, Eckental (DE); Harald Wich, Lauf (DE); Lutz Lehmann, Schanaittach (DE)

(73) Assignee: Diehl Munitionssystems GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/219,578

(22) Filed: Aug. 15, 2002

(65) Prior Publication Data

US 2003/0038211 A1 Feb. 27, 2003

(30) Foreign Application Priority Data

Aug. 22, 2001 (DE) ..... 101 41 169

(51) Int. Cl.[7] ..... F41G 7/00; F42B 15/01

(52) U.S. Cl. ..... 244/3.22; 244/3.21; 244/3.1; 244/3.15; 102/347

(58) Field of Search ..... 342/61–65, 357.01–357.17; 244/3.15–3.3; 89/1.8–1.82, 1.11; 102/347–352; 701/200, 207, 213–216

(56) References Cited

U.S. PATENT DOCUMENTS 6,138,945 A * 10/2000 Biggers et al. ..... 244/3.22
6,254,031 B1 * 7/2001 Mayersak ..... 244/3.22
6,460,801 B1 * 10/2002 Mayersak ..... 244/3.22
6,502,785 B1 * 1/2003 Teter et al. ..... 244/3.22

FOREIGN PATENT DOCUMENTS

| | | |
|---|---|---|
| DE | 37 39 370 A1 | 6/1989 |
| DE | 43 25 218 C2 | 2/1995 |
| EP | 636 852 A1 | 2/1995 |

* cited by examiner

*Primary Examiner*—Bernarr E. Gregory
(74) *Attorney, Agent, or Firm*—Scully, Scott, Murphy & Presser

(57) ABSTRACT

The MLRS1 artillery rockets (11) which are stored in the depots of the consumer can enjoy in a technologically non-critical fashion an increase in performance in the sense of a substantially improved degree of delivery precision, insofar as the ogival head (13) is temporarily cut off so that it is possible to fit into same and thus into the foremost region of the original payload space (15), which is behind the fuse (12), in a position of surrounding the pyrotechnic delivery ejection system, an annular assembly frame (21) for a transverse thrust unit (23) with reaction elements (25), which blow out radially around the rocket, which, in dependence on position, can be individually triggered by a navigation satellite-supported course correction unit (20) which is also fitted there.

5 Claims, 2 Drawing Sheets

ARTILLERY ROCKET

BACKGROUND OF THE INVENTION

1. Field of the Invention

Figure 1:
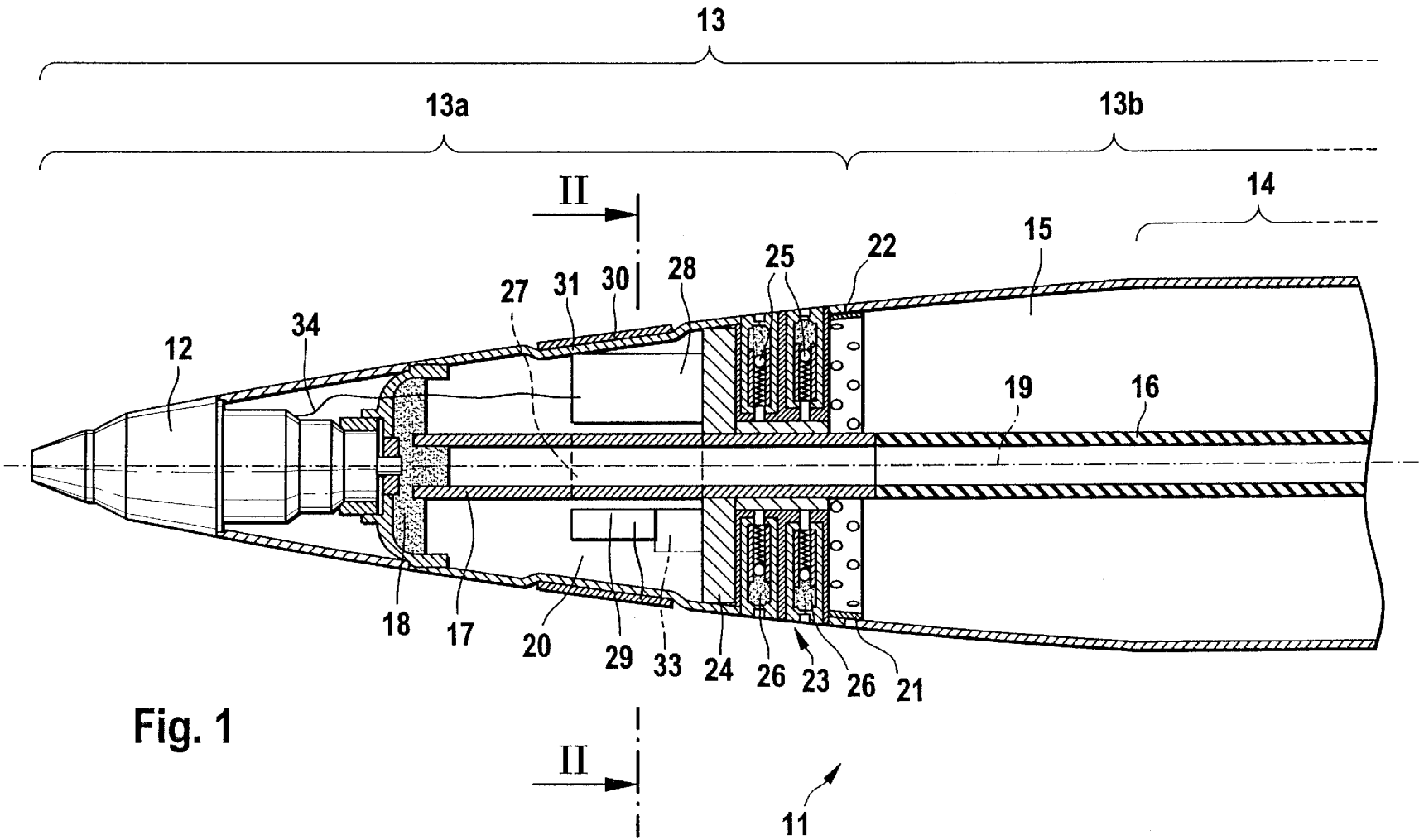

The invention concerns an artillery rocket with a course correction unit which is actuated by a satellite receiver.

2. Discussion of the Prior Art

The artillery rocket of the general kind specified is known from DE 43 25 218 C2. This involves an MLRS1-rocket which, to increase its range, is provided with canards in order to be able to extend the falling leg of the ballistic trajectory by virtue of the lift effect of the canards at the ogival head of the rocket structure. So that in that case the error level does not rise to an incompatible degree, the rocket is equipped with a satellite navigation system for correcting the current trajectory, having regard to the predetermined target co-ordinates. Trajectory correction is effected in a dynamic flight mode by variable setting of the canards, depending on the respective position which is just being adopted at that time in space, in the course of the rolling movement of the rocket. As, to provide a stable trajectory, actuation of the canards must always be effected in such a way as to follow the continuous rotation of the rocket, the control complication and expenditure is considerable and correspondingly functionally critical. In addition the amount of space required for installing the drive devices for continuously changing the canard setting and the power supply which is to be made available on board for that purpose are quite considerable.

A version which is modified in relation to the rocket of the artillery rocket system MLRS1 is described in DE 37 39 370 A1. Rockets of that kind are fired from a launch barrel and, immediately after leaving the barrel, are accelerated by way of a rocket drive which is active for a short time, into an aerodynamically stabilised ballistic trajectory which extends relatively flat and along which it performs a slight rolling movement for the purposes of compensating for interference influences due to the launch. A time setting, which is implemented prior to launch, of a time fuse in the tip of the ogival head of the rocket, when the rocket has arrived over the target area, initiates a gas generator which is also disposed in the ogival head, for filling an inflation hose which extends coaxially along the axis of the system through the payload space within the rocket casing. With the increase in the diameter of the inflation hose, the inflation hose presses submunitions which are packed in parallel relationship with the axis in line configurations therearound, from the inside radially outwardly against the rocket casing, and breaks the rocket casing open along desired-rupture locations in order to laterally discharge the stacks of submunitions.

However much the MLRS1 system which was introduced to the consumer years ago has basically proven its worth, there nonetheless still remain problems as to whether the advised target area for expulsion of the submunitions was actually reached within the flight time which was predetermined at the fuse. For, while the environmental influences which apply upon launch can still be incorporated into calculation of the time presetting, by a weapons management system, irregularities in operation of the rocket motor and thereafter in the condition of free flight, depending on the respective wind strength, wind direction and air pressure, mean that numerous forces which could not be already taken into account at the beginning when presetting the flight time not only have a braking effect on the rocket body but in particular also have a deflecting effect thereon. Because of deceleration effects and deviations from the predetermined trajectory, that results in transverse and lateral delivery errors, as departures from the predetermined target position, and that therefore results in the system capability of the rocket carrier for the submunitions being adversely affected.

Admittedly it is known for example from EP 0 418 636 A2, in the case of a spin-stabilised projectile, to implement trajectory correction by means of transverse thrust units, depending on the respective instantaneous active direction thereof, in space. When it acts through the aerodynamic centre of gravity of the projectile, the transverse thrust results in transverse displacement of the trajectory, while when its action is displaced out of the cross-sectional plane of the centre of gravity, depending on the instantaneous spatial position of the projectile, by virtue of tilting of the longitudinal axis, such transverse thrust results in a pitching or yawing movement, with corresponding changes in trajectory. However, in order in that situation not to lose target acquisition, such correction measures also require a search head with an algorithm for active or passive target tracking for target-oriented trajectory correction. This is a very expensive technology; and such target contacting generally cannot be implemented at all if, as in the case of delivering bomblets, the situation involves use in relation to an area target, without a defined target point or a target point which can be captured by sensor means.

SUMMARY OF THE INVENTION

In consideration of those aspects, the technical object of the present invention is to be able to provide the MLRS1 artillery rockets which the consumer has in store in a depot with technologically risk-free interventions which can be implemented as easily as possible, in terms of an increase in performance, in regard to more precise delivery of the submunitions.

A design configuration with transverse thrust units corresponding to EP 0 418 636 A2 cannot be considered for the purposes of attaining that object, because that would require interventions into the rocket structure, which would result in an item of equipment which is new in terms of procurement law. As this does not involve an increase in range, the invention also does not involve considering the mechanical and control-technology expenditure and complication involved with a canard control system. Instead, the object of the invention is achieved by carrying out the combination of features in the main claim, whereby the foremost section of the load space in the rocket where the casing already tapers from the hollow-cylindrical structure to the ogival head, is cut off and emptied of submunitions. From the location where the casing is cut off, an additional frame in the form of an axially thick assembly or intermediate plate member in the form of an annual disc, for a course correction unit together with a transverse thrust unit, is inserted, with a rearwardly remaining axial projecting portion, into the interior of the conically tapering ogival head, and riveted to the cut edge of the ogival head. Finally, the rocket casing which rearwardly adjoins the plane in which the casing was cut is riveted onto the frame which then therefore still projects rearwardly with approximately half its height in an annular shape out of the ogival head, whereby the rocket is again ready for use, in its original external configuration.

The transverse thrust unit is provided with an at least single-layer ring of miniaturised pyrotechnic reaction elements which act radially with respect to the longitudinal axis of the rocket. A navigational device is disposed in front of the reaction elements, in the ogival head. Navigation in the sense of tracking the actual trajectory which is actually flown and at least one course correction for finally flying directly to the predetermined delivery co-ordinates is preferably effected by way of a coil antenna for receiving the signals from navigation satellites, with the antenna being let into the substantially conical outside peripheral surface of the ogival head.

The instantaneous roll position in space, which determines the pulse direction for carrying out a predetermined change in direction of the flight of the rocket by means of a given one of the reaction elements which have not yet been consumed in carrying out earlier corrections is to be detected in a particularly reliable fashion, within the course correction unit, without in that respect involving a great deal of apparatus complication and expenditure, in a manner which is known as such, by means of a magnetic sensor which rotates with the rocket and which responds to the magnetic field of the Earth, over the periodicity of the variation in respect of time of the signal amplitude thereof, because it does not operate in dependence on brightness and thus it also operates in particular independently of the weather.

A microprocessor for comparison of the actual and reference positions, which is to be implemented repeatedly during the flight, and for directionally selective triggering of transverse thrust reaction elements for implementing correction requirements when such are established, also readily has the capacity, when the reference position over the target area is reached, to generate the signal for firing the gas generator for expelling the submunitions.

BRIEF DESCRIPTION OF THE ACCOMPANYING DRAWINGS

Figure 2:
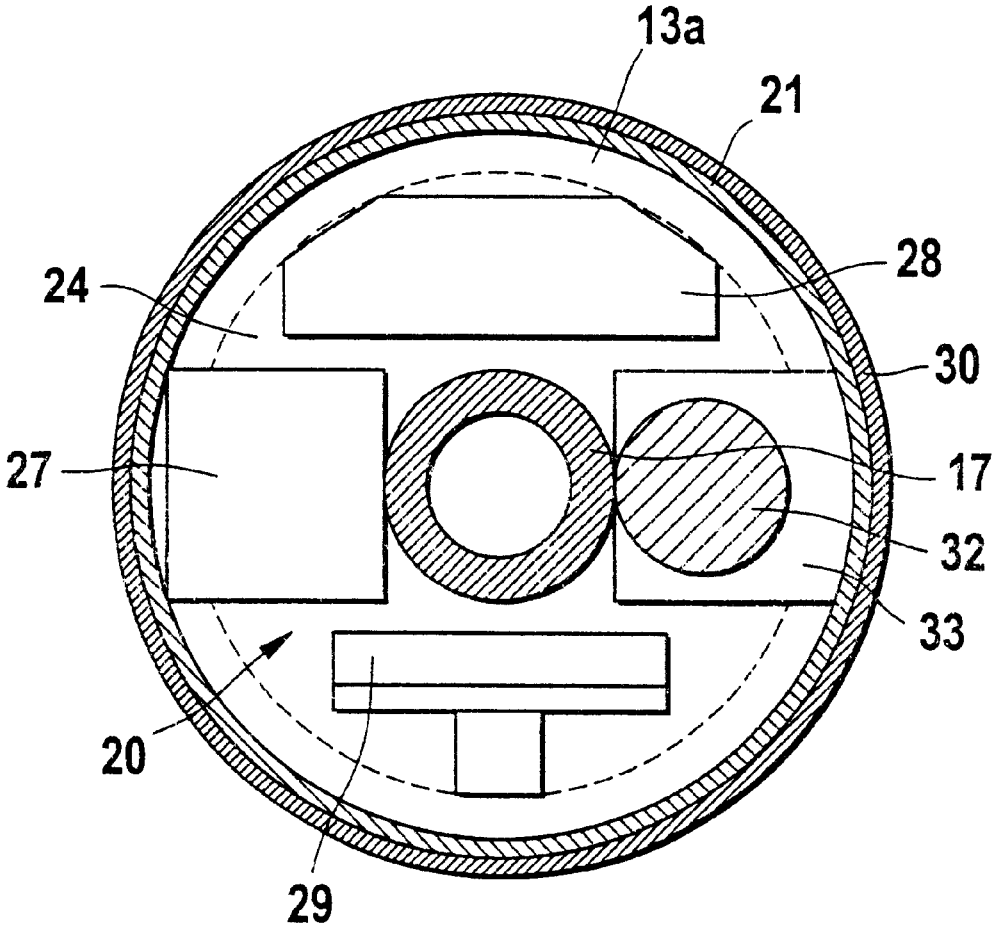

In regard to further advantages and additional modifications and developments, besides the further claims, attention is directed to the description hereinafter of a preferred embodiment of the structure according to the invention, which is set forth in diagrammatic form, being limited to what is essential, but approximately true to scale. In the drawing:

FIG. 1 shows a broken-away axial longitudinal section of the ogival head, which is equipped at the tip with a fuse, of an artillery rocket, as far as the transition to the hollow-cylindrical structure thereof, and FIG. 2 shows the correction units fitted into the ogival head, in the cross-sectional plane indicated at II—II in FIG. 1.

DETAILED DESCRIPTION OF A PREFERRED EMBODIMENT

The foremost section of an artillery rocket 11, which is diagrammatically shown in axial longitudinal section, includes the ogival head 13, with a fuse 12 in its tip, as far as the transition to the hollow-cylindrical casing 14 of the rocket body. A payload space 15 for submunitions (not shown in the drawing) which are stacked in parallel relationship with the axis in itself extends into the rearward region of the ogival head 13. Extending coaxially through the payload space 15 is a hose 16 which is connected by way of a gas pipe 17 to a pyrotechnic gas generator 18 directly behind the fuse 12. The gas generator 18 can be initiated by the fuse 12. The production of gas then inflates the hose 16 and thereby presses the load of the payload space 15 radially against the casing 14 of the rocket structure until it tears open at desired-rupture locations, whereby the submunitions are expelled transversely with respect to the longitudinal axis 19 of the rocket 11.

That delivery procedure upon arriving over the target area is triggered in conventional manner by a time-settable fuse 12. As indicated in the opening part of the specification however, numerous environmental influences which are not sufficiently accurately known in advance have the result that the rocket 11 has frequently not in any way reached its predetermined target area, when the preset time delay has expired, because the flight of the rocket was slowed down or was deflected out of the reference or intended direction. For that reason, discharge of the submunitions precisely over the predetermined target area is basically not sufficiently guaranteed, by means of pure time control.

In order to afford remedies in that respect, in accordance with the invention the foremost portion of the payload space 15 which is behind the fuse 12 and the gas generator 18 is freed of submunitions in order here to dispose a course correction unit 20 with a transverse thrust unit 23. For that purpose, the ogival head 13 is cut off immediately in front of the remaining payload space 15 so that, after emptying of the submunitions, an additional, axially thick annular frame 21 acting as an assembly plate member for the functional elements for navigation and course control, can be installed here, being pushed from the separation plane 22 into the slightly conically tapering interior of the ogival head 18. After being installed, the frame 21 also serves to assemble the two ogive portions 13*a*, 13*b* on both sides of the separation plane 22 again in coaxial butting relationship. The end faces on both sides of the separation plane 22, which come together flush here, are then radially screwed or riveted to the frame 21, thereby restoring the original rocket contour. The above-mentioned rearward ogive portion 13*b* is the part of the rocket structure which is in adjoining relationship in front of the hollow-cylindrical casing 14 and into which the payload space 15 now only extends, after installation of the frame 21.

Towards the fuse 12, the annular frame 21 carries the course correction unit 20 in front of a frustoconical transverse thrust unit 23 and a wiring board 24. Those fitments are also of an annular arrangement or configuration so that, as diagrammatically illustrated, the gas pipe 17 from the fuse 12 or the gas generator 18 can extend concentrically through the frame 21 to the connection of the inflation hose 16 in the payload space 15.

The transverse thrust unit 23 is equipped with a ring of reaction elements 25 based on a pyrotechnic reaction, the reaction elements 25 being distributed if required, as diagrammatically illustrated, to a plurality of transverse planes which are disposed one in front of the other. As diagrammatically illustrated, the reaction elements 25 can be installed in a radial orientation. It may be structurally more advantageous however for the small drive units (that is to say the reaction elements 25) to be stacked in parallel relationship with the axis and to be connected to vapour passages which, after a change in direction, then open in a radial direction through the casing in order as a reaction to trigger the transverse thrust pulse.

The direction in which a change in course is produced thereby depends on the direction in space in which the discharge direction of the reaction element 25 which has not yet been consumed and which is now to be activated is oriented at the time. That current spatial position is established in that detection of the magnetic field of the Earth which recurs periodically in the course of the rolling movement of the rocket 11, is registered by means of a rolling position sensor 27 which is included on the circuit board 24 and which preferably responds magnetically. That periodicity represents the inverse of the duration of a revolution of the rocket 11 about its longitudinal axis 19 so that, within that period, any angle of rotation can be interpolated in respect of time, in relation to a spatial reference direction, with a sufficient degree of accuracy. That is effected in a signal processor 28 which also processes the navigational data from a satellite receiver 29 which is connected to a coil antenna 30 which is fitted into a shallow peripherally extending recess 31 in the front part of the ogival head 13.

The co-ordinates of the target area for the current mission, that is to say for discharge of the submunition, are predetermined in a memory in the signal processor 28. That information is quasi-continuously compared to data relating to the position which has currently been reached, having regard to the instantaneous direction of the trajectory of the rocket 11. Such data are obtained by way of the navigation satellite receiver 29 so that, for the purposes of trajectory correction towards the predetermined target co-ordinates, if necessary at least one of the reaction elements 25 is initiated, when the rocket 11 is in the spatial position that is just appropriate, having regard to the orientation, which is fixed in regard to the system, of the reaction elements which are still available.

In addition the board 24 is provided with a power supply 32 (preferably an activatable battery with an electronic voltage converter circuit) for operation of the described additional components. A firing distribution circuit 33 supplies the initialisation connection from the signal processor 28 to those of the reaction elements, which are still ready for operation and which are to be currently enabled, to provide a given course influence. The fuse 12 no longer operates under time control, but it is triggered by way of a firing line 34 from the signal processor 28 when the rocket 11 has reached the reference position which is predetermined for discharge of the submunitions.

The MLRS1 artillery rockets 11 which are stored in the depots of the consumer can therefore enjoy, in accordance with the invention, in a technologically non-critical fashion, an increase in performance in the sense of a substantially improved degree of delivery precision, insofar as the ogival head 13 is temporarily cut off so that it is possible to fit into same and thus into the foremost region of the original payload space 15, which is behind the fuse 12, in a position of surrounding the pyrotechnic delivery ejection system, an annular assembly frame 21 for a transverse thrust unit 23 with small reaction elements 25, which act radially around the rocket, in the form of pulse drive units (with pyrotechnic repulsion of a mass 26), or rocket drive units which, in dependence on position, can be individually triggered by a navigation satellite-supported course correction unit 20 which is also fitted there.

What is claimed is:

1. An artillery rocket having an ogival head (13) extending into a payload space (15), said artillery rocket comprises an annular frame (21) arranged at a leading end region of said payload space (15) and extending into said ogival head (13), said annular frame (21) being equipped with a course correction unit (20) and with a transverse thrust unit (23); and a satellite receiver (29) in said ogival head (13) being operatively connected to said course correction unit (20) for actuation of said course correction unit (20).

2. An artillery rocket according to claim 1, wherein said annular frame (21) is fitted over a part of its axial thickness from a separation plane (22) into a front ogive portion **(13*a*) of said ogival head, and serves for joining both ogive front and rear portions (13*a*–13*b*)** together.

3. An artillery rocket according to claim 1, wherein the course correction unit (20) is actuated by a roll position sensor (27) and said navigation satellite receiver (29) and actuates the transverse thrust unit (23) which has an at least single-layer ring of reaction elements (25) which can be activated individually in dependence on position.

4. An artillery rocket according to claim 1, wherein the reaction elements (25) are small rocket or pulse drive units which are installed parallel to the longitudinal axis of the ogival head but which blow out radially through direction-changing passages.

5. An artillery rocket according to claim 1, wherein a fuse (12) is actuable by the course correction unit (20) for initiating a gas generator (18) to which an inflation hose (16) for laterally discharging submunitions is connected coaxially through the frame (21) with its course correction and transverse thrust units (20, 23).

* * * * *